US006663768B1

(12) United States Patent
Miller

(10) Patent No.: US 6,663,768 B1
(45) **Date of Patent: *Dec. 16, 2003**

(54) PREPARING A HGH VISCOSITY INDEX, LOW BRANCH INDEX DEWAXED

(75) Inventor: Stephen J. Miller, San Francisco, CA (US)

(73) Assignee: Chevron U.S.A. Inc., San Francisco, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/107,835

(22) Filed: Jun. 30, 1998

Related U.S. Application Data

(60) Provisional application No. 60/077,070, filed on Mar. 6, 1998.

(51) Int. Cl.[7] ..... C10G 73/38

(52) U.S. Cl. ..... 208/27; 208/28; 208/33; 208/95; 208/96; 208/97

(58) Field of Search ..... 208/27, 28, 33, 208/137, 138, 141, 18, 95, 96, 97

(56) References Cited

U.S. PATENT DOCUMENTS

| | | | | | |
|---|---|---|---|---|---|
| 4,259,170 | A | * | 3/1981 | Graham et al. | 208/33 |
| 4,440,871 | A | | 4/1984 | Lok et al. | 502/214 |
| 4,501,926 | A | | 2/1985 | LaPierre et al. | 585/739 |
| 4,574,043 | A | * | 3/1986 | Chester et al. | 208/59 |
| 4,678,556 | A | * | 7/1987 | Hicks et al. | 208/96 |
| 4,859,311 | A | | 8/1989 | Miller | 208/89 |
| 4,867,862 | A | | 9/1989 | Ziemer | 208/27 |
| 4,880,760 | A | | 11/1989 | Pellet et al. | 502/67 |
| 4,906,351 | A | | 3/1990 | Pellet et al. | 208/111 |
| 4,911,821 | A | * | 3/1990 | Katzer et al. | 208/27 |
| 4,919,788 | A | * | 4/1990 | Chen et al. | 208/59 |
| 4,921,594 | A | | 5/1990 | Miller | 208/58 |
| 4,960,504 | A | | 10/1990 | Pellet et al. | 208/411 |
| 4,975,177 | A | * | 12/1990 | Garwood et al. | 208/27 |
| 5,037,528 | A | * | 8/1991 | Garwood et al. | 208/27 |
| 5,082,986 | A | | 1/1992 | Miller | 585/667 |
| 5,113,030 | A | * | 5/1992 | Chen et al. | 585/10 |
| 5,135,638 | A | | 8/1992 | Miller | 208/27 |
| 5,149,421 | A | | 9/1992 | Miller | 208/114 |
| 5,246,566 | A | | 9/1993 | Miller | 208/27 |
| 5,264,116 | A | * | 11/1993 | Apelian et al. | 208/111 |
| 5,282,958 | A | | 2/1994 | Santilli et al. | 208/111 |
| 5,288,395 | A | * | 2/1994 | Marler et al. | 208/58 |
| 5,292,426 | A | | 3/1994 | Holland et al. | 208/111 |
| 5,302,279 | A | | 4/1994 | Degnan et al. | 208/87 |
| 5,362,378 | A | | 11/1994 | Borghard et al. | 208/138 |
| 5,376,260 | A | * | 12/1994 | Santilli et al. | 208/111 |
| 5,413,695 | A | * | 5/1995 | Miller | 208/28 |
| 5,462,650 | A | | 10/1995 | Takito et al. | 208/58 |
| 5,643,440 | A | | 7/1997 | Borghard et al. | 208/58 |
| 5,833,837 | A | * | 11/1998 | Miller | 208/80 |
| 5,885,438 | A | * | 3/1999 | Apelian et al. | 208/27 |
| 6,090,989 | A | * | 7/2000 | Trewella et al. | 508/110 |

FOREIGN PATENT DOCUMENTS

| | | |
|---|---|---|
| EP | 0 225 053 A1 | 10/1986 |
| EP | 0 464 546 A1 | 6/1991 |
| WO | WO 96/13563 | 10/1995 |
| WO | WO 96/26993 | 12/1995 |
| WO | WO96/07715 | 3/1996 |
| WO | PCT/FR96/01364 | 3/1997 |
| WO | WO97/26989 | 7/1997 |

OTHER PUBLICATIONS

Baker, C. L., and McGuiness, M. P., "Mobil Lube Dewaxing Technologies," NPRA Mtg. (1995), Paper No. AM–95–56.

* cited by examiner

*Primary Examiner*—Walter D. Griffen
(74) *Attorney, Agent, or Firm*—A. Stephen Zavell; Alan W. Klaassen

(57) ABSTRACT

An integrated process for preparing a lubricating oil base stock includes an isomerization step followed by a solvent dewaxing step. A waxy feed is isomerized to an intermediate pore point, which is at least 6° C. above a target pour point, over a select molecular sieve having specified pore properties. The isomerized oil is then solvent dewaxed to a very low pour point. This process produces a dewaxed lubricating oil base stock which has an exceptionally high viscosity index.

35 Claims, 2 Drawing Sheets

PREPARING A HGH VISCOSITY INDEX, LOW BRANCH INDEX DEWAXED

This patent application claims priority from U.S. Provisional Patent Application Ser. No. 60/077,070, filed Mar. 6, 1998, the specification of which is incorporated herein by reference for all purposes.

BACKGROUND OF THE INVENTION

The present process is a dewaxing process for producing very high viscosity index, low pour point lubricating oil base stocks from a mineral oil feed. When preparing a lubricating oil base stock from a mineral oil, viscosity index is generally increased to a target value during an upgrading step using hydrocracking, solvent refining, etc. Pour point is generally reduced to a target value during a dewaxing step, using catalytic or solvent dewaxing. In conventional processes, the viscosity index generally decreases during dewaxing, since conventional dewaxing processes remove high viscosity index wax from the lubricating oil base stock. Improvements in automotive engine design is putting ever increasing pressure on the quality of motor oils. Demand for low volatility oils having superior low temperature properties is increasing, and refiners are constantly looking for new processes to aid them in meeting current demands.

High quality lubricants should be, and generally are, paraffinic in nature, since paraffins have a high viscosity index. However, normal paraffins, in particular, are waxy in character, and contribute to a high pour point in the oil. Conventional processes for removing these normal paraffins reduce yield of the lubricant, and have a tendency to reduce the viscosity index of the dewaxed oil. The viscosity index may be increased in the lubricating oil base stock by addition of viscosity index improvers. However, viscosity index improvers are expensive, and tend to fragment at conditions of high temperature and high shear, both of which are commonly found in modern automotive engines.

Synthetic lubricants may be used when very low pour point and very high viscosity index lubricants are desired. But the starting materials used to make the synthetic lubricants, and the processes used in manufacturing these lubricants, are very expensive. The need remains for a lubricating oil base stock, having synthetic-like properties but prepared from a mineral oil feed using methods which are similar to those presently employed in refinery processes.

A major breakthrough came with the discovery of new dewaxing catalysts which were found to isomerize rather than crack the wax molecules. Isomerization alters the molecular structure of wax molecules, and generally decreases the pour point of the molecule without significantly changing its boiling point. In contrast to solvent dewaxing and to wax cracking, isomerized molecules are retained in the lubricating oil base stock, increasing yield of lubricating oil base stock without reducing viscosity index significantly. A particularly important group of isomerization catalysts include the silicoaluminophosphate molecular sieves (SAPO). The preparation of silicoaluminophosphate molecular sieves, including SAPO-11, SAPO-31 and SAPO-41, are taught, for example, in U.S. Pat. No. 4,440,871. Dewaxing processes using such molecular sieves are taught in U.S. Pat. No. 4,859,311; U.S. Pat. No. 4,867,862; U.S. Pat. No. 4,921,594; U.S. Pat. No. 5,082,986; U.S. Pat. No. 5,135,638; U.S. Pat. No. 5,149,421; U.S. Pat. No. 5,246,566; U.S. Pat. No. 5,413,695; and U.S. Pat. No. 4,960,504.

SAPO molecular sieves belong to an important class of non-zeolitic molecular sieve dewaxing catalysts which are useful as isomerization catalysts for converting wax and wax-like components. Non-zeolitic molecular sieves are microporous compositions that are formed from $AlO_2$ and $PO_2$ tetrahedra which form 3-dimensional crystalline structures, and are described broadly for this use in U.S. Pat. No. 4,906,351 and U.S. Pat. No. 4,880,760.

These catalysts with isomerization and hydroisomerization activity have been found to provide a method for preparing very high viscosity index lubricating oil base stocks from waxy feedstocks in a single reaction step. Producing a $C_{20}^{+}$ lube oil from olefins, including normal alpha olefins, using an intermediate pore size molecular sieve and at least one Group VIII metal, is taught in U.S. Pat. No. 5,082,986. In U.S. Pat. No. 5,135,638, a waxy feed containing greater than about 50% wax is isomerized over a catalyst comprising a molecular sieve having 1-D pores having a minor axis between about 4.2 Å and about 4.8 Å and a major axis between about 5.4 Å and about 7.0 Å and at least one Group VIII metal at a pressure of from about 15 psig (103 kPa) to about 2000 psig (13.8 MPa). SAPO-11, SAPO-31, SAPO-41, ZSM-22, ZSM-23 and ZSM-35 are included in U.S. Pat. No. 5,135,638 as intermediate pore size materials which possess the indicated pore geometry. In U.S. Pat. No. 5,282,958, a feed including straight chain and slightly branched chain paraffins having 10 or more carbon atoms is isomerized with an intermediate pore size molecular sieve having a defined pore geometry, crystallite size, acidity and isomerization selectivity. Feeds which may be processed by the method of U.S. Pat. No. 5,282,958 include waxy feeds, which contain greater than about 50% wax. Such feeds are also taught as often containing greater then 70% paraffinic carbon. U.S. Pat. No. 5,376,260 is directed to pour point reduction of a heavy oil which contains naphthenic wax, using SSZ-32. Heavy oils comprising up to 100% wax are taught.

Large pore zeolites represent another class of catalysts which have been taught for wax isomerization. EP 464546 teaches producing a high viscosity index lubricant from a petroleum wax feed having a paraffin content of at least 40 weight percent. The catalyst is a low acidity zeolite isomerization catalyst having an alpha value of not more than 20. Zeolite beta which contains boron as a framework component of the zeolite is taught as being preferred. The catalyst in WO 96/26993 is a low acidity large pore zeolite isomerization catalyst having a ratio of $SiO_2/Al_2O_3$, as synthesized, of at least 200:1. WO 96/13563 teaches an isomerization process for producing a high viscosity index lubricant using a low acidity large pore molecular sieve having a crystal size of less than 0.1 micron, an alpha value of not more than 30 and containing a noble metal hydrogenation component. EP 225053 teaches isomerization dewaxing using a large pore, high silica zeolite dewaxing catalyst, followed by a subsequent dewaxing step which selectively removes the more waxy n-paraffin components. The selective dewaxing step may be either a solvent or a catalyst dewaxing, preferably using highly shape selective zeolite such as ZSM-22 or ZSM-23.

While the intermediate pore size molecular sieves have been shown to be effective for producing high viscosity index lubricating oil base stocks, the need remains for even higher viscosity index products which have been dewaxed to a low pour point.

SUMMARY OF THE INVENTION

An object of the present invention is to provide a process for producing an oil, having a very high viscosity index and a very low pour point, which is suitable for use as a lubricating oil base stock. The feedstock to the present process is a waxy feed which may be derived from mineral oils and mineral oil crudes. The oil which is produced has lubricating oil properties that approach, and may exceed, the lubricating oil properties of a synthetic lubricating oil base stock. Accordingly, the present invention provides a process for preparing an oil suitable for use as a lubricating oil base stock and having a viscosity index of greater than 140 and a target pour point of less than or equal to −10° C. comprising:

a) contacting a waxy feed over a catalyst comprising a molecular sieve having 1-D pores with a pore diameter of between about 5.0 Å and about 7.0 Å, and at least one Group VIII metal, at a pressure of from about 15 psig (103 kPa) to about 2500 psig (13.8 MPa) to produce an isomerized oil having a pour point of at least 6° C. above a target pour point; and b) solvent dewaxing the isomerized oil to produce a lubricating oil base stock having the target pour point and a viscosity index of greater than about 140.

A particularly preferred molecular sieve useful in the isomerization step has sufficient isomerization selectivity such that, when contacting a n-$C_{24}$ feed at a total pressure of 1000 psig (6.99 MPa), hydrogen flow equivalent to 6.7 MSCF/bbl (1010 std liters $H_2$/kg oil), and a feed rate equivalent to 0.6 $hr^{-1}$ LHSV with a catalyst comprising the molecular sieve, to produce a 316° C.+ dewaxed product having a pour point of about +20° C. and solvent dewaxing the dewaxed product to a pour point of −15° C. or below, an isomerized product having a branching index of less than about 1.75 is formed.

The process is capable of producing an oil having a very high viscosity index, e.g., greater than about 140 or even greater than about 150. The process is further capable of producing an oil having a very low pour point, e.g. less than or equal to about −10° C., or less than or equal to about −20° C., or even less than or equal to about −30° C.

In another embodiment, the present invention provides a unique lubricating oil base stock, which has a viscosity index of at least about 140, preferably at least about 150 and more preferably at least about 160, a pour point of less than or equal to about −10° C., and a viscosity, measured at 100° C., of about 3 cSt or less.

IN THE FIGURES

DETAILED DESCRIPTION OF THE INVENTION

Figure 1:
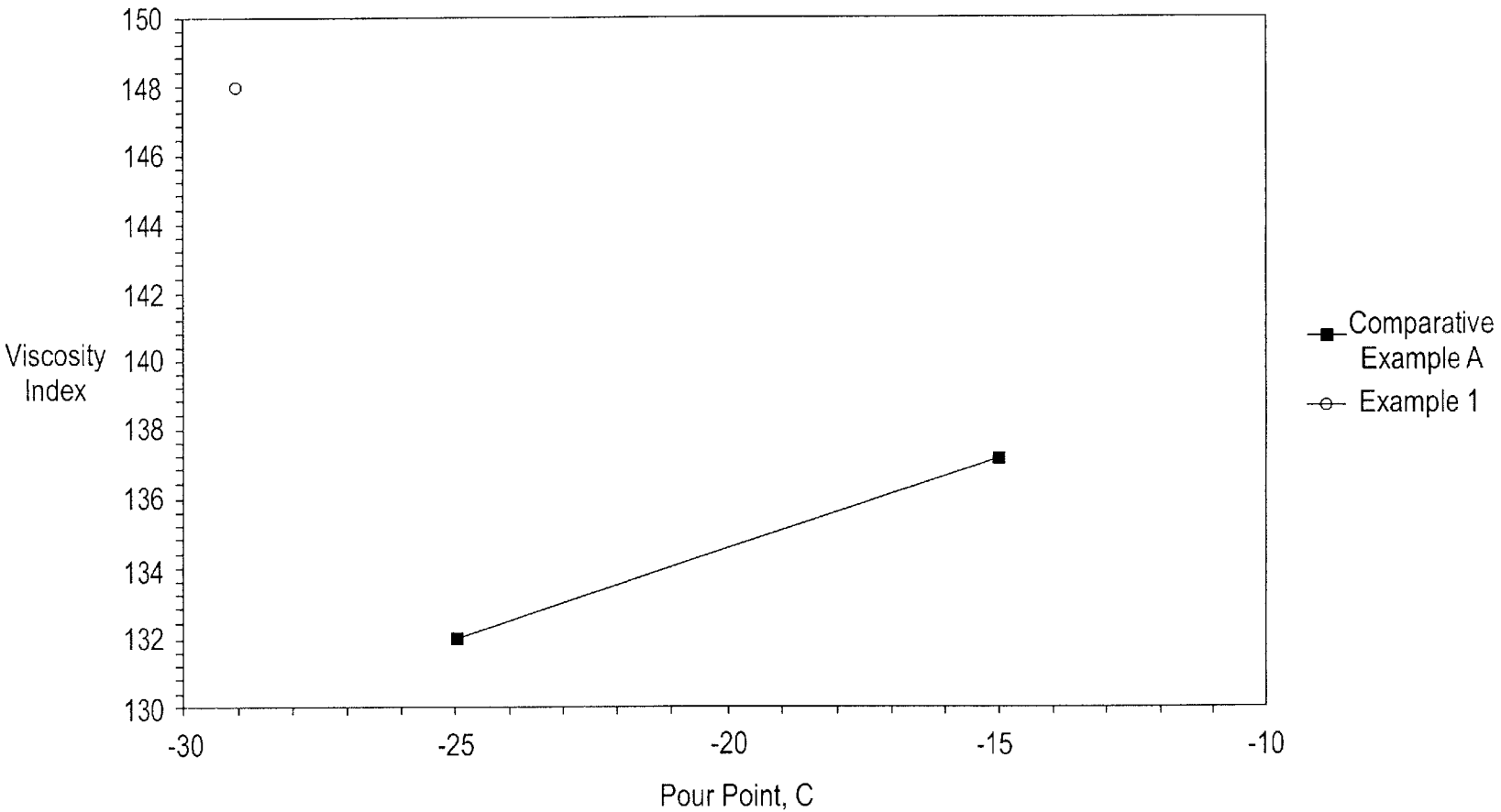
FIG. 1 shows the benefit of isomerizing a waxy feed with SM-3 and solvent dewaxing the isomerized oil compared to isomerizing the waxy feed alone.

Normal paraffins are a major contributor to wax and a high pour point in a lubricating oil base stock. It is desirable to isomerize the normal paraffins to low pour point branched paraffins which retain the boiling range of the normal paraffins from which there were converted.

Among other factors, the present invention is based on the discovery that the number of branches produced while isomerizing a normal paraffin molecule significantly impacts the quality of the dewaxed oil product. For example, isomerizing a normal $C_{24}$ paraffin, tetracosane, using a large pore zeolite catalyst conventionally taught for wax isomerization, generally produces a significant quantity of triply branched paraffin isomers. Even medium pore catalysts taught for wax isomerization, when isomerizing a waxy feed to a low pour point, produces significant quantities of the triply branched isomers. While not wishing to be bound by theory, it is believed that normal paraffins are first converted during wax isomerization to a singly branched paraffin having a methyl (—$CH_3$) or ethyl (—$C_2H_5$), branch near the end of the paraffin backbone. Additional isomerization reactions move the branch toward the center of the paraffin molecule and/or add a second branch to the paraffin molecule. Each of these two isomerization reaction steps reduces pour point.

However, conventional single stage and/or large pore zeolite dewaxing processes are unselective for forming branches. These unselective catalysts produce triply (or even more highly) branched isomers along with the singly and doubly branched isomers before reaching the target pour point. These highly branched molecules have an increased tendency to crack and have a lower viscosity index than do singly or doubly branched paraffins. Furthermore, the addition of a third branch to a doubly branched paraffin often results in relatively little additional pour point reduction. Thus, these conventional processes are prevented from producing lubes with the desired viscosity index and pour point properties.

In the present process, normal paraffins are isomerized at high selectivity to singly and doubly branched paraffins using a process which produces few triply branched paraffins. The shape selective catalyst of the present invention, comprising a 1-D intermediate pore size molecular sieve, restricts the amount of triply branched paraffins which are formed in the isomerization of a waxy feed, while producing a product having an intermediate pour point. The remaining wax is removed in a solvent dewaxing step to produce a lubricating oil base stock with a very low pour point and a viscosity index which approaches, and can exceed, the viscosity index of synthetic lubricants having the same viscosity. As used herein, a normal paraffin, or alkane, is a saturated aliphatic hydrocarbon containing only —$CH_3$ and —$CH_2$— groups. A branched paraffin is a saturated aliphatic hydrocarbon containing one or more

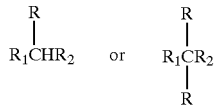

groups. As used herein, each R represents a branch, where R is an alkyl independently selected from —$CH_3$, —$C_2H_5$, —$C_3H_7$, or —$C_4H_9$, and preferably from —$CH_3$ or —$C_2H_5$. $R_1$ and $R_2$ represent portions of the paraffin chain or backbone. Thus, a singly branched paraffin has one R group per paraffin molecule, a doubly branched paraffin two R groups, a triply branched paraffin three R groups, etc.

The feedstock to the present process is a "waxy feed". The feedstock will normally be a $C_{20}^{+}$ feedstock, generally boiling above about 316° C. and containing paraffins, olefins, naphthenes, aromatics and heterocyclic compounds and a substantial proportion of higher molecular weight n-paraffins and slightly branched paraffins which contribute to the waxy nature of the feedstock. Hydroprocessed stocks are a convenient source of stocks of this kind and also of other distillate fractions since they normally contain significant amounts of waxy n-paraffins.

As used herein, the term "waxy feed" includes petroleum waxes. Exemplary suitable feeds for use in the process of the invention also include waxy distillate stocks such as gas oils, lubricating oil stocks, synthetic oils and waxes such as those by Fischer-Tropsch synthesis, high pour point polyalphaolefins, foots oils, normal alpha olefin waxes, slack waxes, deoiled waxes and microcrystalline waxes. Slack wax is wax recovered from a conventional solvent dewaxing process. Slack wax can be obtained from either a straight run gas oil, a hydrocracked lube oil or a solvent refined lube oil. Hydrocracking is preferred because that process can also reduce the nitrogen content to low values. With slack wax derived from solvent refined oils, deoiling can be used to reduce the nitrogen content. Optionally, hydrotreating of the slack wax can be carried out to lower the nitrogen content thereof. Slack waxes possess a very high viscosity index, normally in the range of from 120 to 200, depending on the oil content and the starting material from which the wax has been prepared. Slack waxes are therefore eminently suitable for the preparation of lubricating oils having very high viscosity indices, i.e., from about 140 to about 180. Foots oil is prepared by separating oil from the wax. The isolated oil is referred to as foots oil.

The feedstock employed in the process of the invention preferably contains greater than about 50% wax, more preferably greater than about 80% wax, most preferably greater than about 90% wax. However, a highly paraffinic feed having a high pour point, generally above about 0° C., more usually above about 10° C., but containing less than 50% wax is also suitable for use in the process of the invention. Such a feed should preferably contain greater than about 70% paraffinic carbon, more preferably greater than about 80% paraffinic carbon, most preferably greater than about 90% paraffinic carbon.

A catalyst useful in the present process comprises an intermediate pore size molecular size and a hydrogenation component. Catalysts of this type are taught in U.S. Pat. No. 5,135,638, the entire disclosure of which is incorporated herein by reference for all purposes. The phrase "intermediate pore size", as used herein means an effective pore aperture in the range of from about 5.0 to about 7.0 Å, preferably from about 5.3 to about 6.5 Å, when the porous inorganic oxide is in the calcined form. The effective pore size of the molecular sieves can be measured using standard adsorption techniques and hydrocarbonaceous compounds of known minimum kinetic diameters. See Breck, Zeolite Molecular Sieves. 1974 (especially Chapter 8); Anderson et al., J. Catalysis 58, 114 (1979); and U.S. Pat. No. 4,440,871, the pertinent portions of which are incorporated herein by reference.

In performing adsorption measurements to determine pore size, standard techniques are used. It is convenient to consider a particular molecule as excluded if it does not reach at least 95% of its equilibrium adsorption value on the molecular sieve in less than about 10 minutes (p/po=0.5; 25° C.).

Intermediate pore size molecular sieves will typically admit molecules having kinetic diameters of 5.3 to 6.5 Å with little hindrance. Examples of such compounds (and their kinetic diameters in Å) are: n-hexane (4.3), 3-methylpentane (5.5), benzene (5.85), and toluene (5.8). Compounds having kinetic diameters of about 6 to 6.5 Å can be admitted into the pores, depending on the particular sieve, but do not penetrate as quickly and in some cases are effectively excluded. Compounds having kinetic diameters in the range of 6 to 6.5 Å include: cyclohexane (6.0), 2,3-dimethylbutane (6.1), and m-xylene (6.1). Generally, compounds having kinetic diameters of greater than about 6.5 Å do not penetrate the pore apertures and thus are not absorbed into the interior of the molecular sieve lattice. Examples of such larger compounds include: o-xylene (6.8), 1,3,5-trimethylbenzene (7.5), and tributylamine (8.1). While the effective pore size as discussed above is important to the practice of the invention, not all intermediate pore size molecular sieves having such effective pore sizes are advantageously usable in the practice of the present invention. Indeed, it is essential that the intermediate pore size molecular sieve catalysts used in the practice of the present invention have a very specific pore shape and size as measured by X-ray crystallography. First, the intracrystalline channels must be parallel and must not be interconnected. Such channels are conventionally referred to as 1-D diffusion types or more shortly as 1-D pores. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75). Known 1-D zeolites include cancrinite hydrate, laumontite, mazzite, mordenite and zeolite L.

In general, the pores of the molecular sieve have a major axis between about 5.0 Å and about 7.0 Å, i.e. the pore diameter of the molecular sieve is between about 5.0 Å and about 7.0 Å. In one embodiment, the preferred molecular sieves useful in the practice of the present invention have pores which are oval in shape, by which is meant the pores exhibit two unequal axes referred to herein as a minor axis and a major axis. The term oval as used herein is not meant to require a specific oval or elliptical shape but rather to refer to the pores exhibiting two unequal axes. In particular, the 1-D pores of the preferred molecular sieves useful in the practice of the present invention have a minor axis between about 3.9 Å and about 4.8 Å and a major axis between about 5.4 Å and about 7.0 Å as determined by conventional X-ray crystallography measurements, following the measurement convention of W. M. Meier and D. H. Olson, ATLAS OF ZEOLITE STRUCTURE TYPES, Butterworth-Heinemann, Third Revised Edition, 1992.

The present invention makes use of molecular sieve catalysts with selected shape selectivity properties. These shape selectivity properties are defined by carrying out standard isomerization selectivity tests for isomerizing tetracosane (n-$C_{24}$). The test conditions include a total pressure of 1000 psig (6.89 MPa), hydrogen flow equivalent to 6.7 MSCF/bbl (1010 std liters $H_2$/kg oil), a feed rate equivalent to 0.6 $hr^{-1}$ LHSV and the use of 0.5 g of catalyst (impregnated with 0.5 wt % Pt and sized to 24–42 mesh [0.35 mm–0.70 mm]) loaded in the center of a 3 feet long (0.91 m) by 3/16 inch (0.48 cm) inner, diameter stainless steel reactor tube (the catalyst is located centrally of the tube and extends about 1 to 2 inches [2.54–5.08 cm] in length) with alundum loaded upstream of the catalyst for preheating the feed. The reactor temperature is adjusted to achieve a pour point of about +20° C. in the 600° F.+(316° C.) distillation bottoms of the reactor effluent. The 600° F.+(316° C.) distillation bottoms are then solvent dewaxed to a pour point of about −15° C.

To account for the extent of isomerization, a branching index is defined to characterize the average number of branches per $C_{24}$ molecule.

$$BranchingIndex = \sum_i i * b_i / b_t$$

where $b_i$ is the amount of paraffins in the product with an "i" number of branches, and $b_t$ is the total amount of paraffins in the product (both normal and branched).

The branching index is determined by analyzing a sample of the product from the standard isomerization selectivity test using carbon-13 NMR according to the following four-step process. References cited in the description detail the process steps.

1. Identify the CH branch centers and the $CH_3$ branch termination points using the DEPT Pulse sequence (Doddrell, D. T.; Pegg, D. T.; Bendall, M. R. *J. Magn. Reson.* 1982, 48, 323ff.).
2. Verify the absence of carbons initiating multiple branches (quaternary carbons) using the APT pulse sequence (Patt, S. L.; Shoolery, J. N. *J. Magn. Reson.* 1982, 46, 535ff.)
3. Assign the various branch carbon resonances to specific branch positions and lengths using tabulated and calculated values (Lindeman, L. P.; Adams, J. Q. *Anal. Chem.* 43, 1971 1245ff: Netzel, D. A. et.al. *Fuel*, 60, 1981, 307ff.
4. Quantify the relative frequency of branch occurrence by comparing the integrated intensity of its terminal methyl carbon to the intensity of a single carbon (=total integral/number of carbons per molecule in the mixture). For the unique case of the isopropyl branch, where both methyl occur at the same resonance position, the intensity was divided by two before doing the frequency of branch occurrence calculation.

All measurements were performed with Varian 300 MHz spectrometers. In all cases the spectral width was limited to the saturated carbon region, about 0–80 ppm vs. TMS (tetramethyl silane). 15–25% solutions by weight in chloroform-d1 excited by 45° pulses followed by an 0.8 sec acquisition time. In order to minimize non uniform intensity data, the proton decoupler was gated off during a 10 sec delay prior to the excitation pulse and on during acquisition. Total experiment times ranged from 11–80 minutes. The DEPT and APT sequences were carried out according to literature descriptions with minor deviations described in the Varian operating manuals.

A catalyst, if it is to qualify as a catalyst of this invention, when tested in this manner, must convert sufficient normal $C_{24}$ paraffin to form an isomerized product having a pour point of about −15° C. or less and a branching index of less than about 1.75. Non-zeolitic molecular sieves having the characteristics of an intermediate pore size molecular sieve as described herein are useful in the present process. Non-zeolitic molecular sieves are microporous compositions that are formed from $AlO_2$ and $PO_2$ tetrahedra. Thus, the process of the invention may be carried out using a catalyst comprising an intermediate pore size non-zeolitic molecular sieve and at least one Group VIII metal. Non-zeolitic molecular sieves are described, for example, in U.S. Pat. No. 4,861,743, the disclosure of which is completely incorporated herein by reference for all purposes. Non-zeolitic molecular sieves include aluminophosphates ($AlPO_4$) as described in U.S. Pat. No. 4,310,440, silicoaluminophosphates (SAPO), metalloaluminophosphates (MeAPO), and nonmetal substituted aluminophosphates (ElAPO). Metalloaluminophosphate molecular sieves are described in U.S. Pat. Nos. 4,500,651; 4,567,029; 4,544,143; 4,686,093 and 4,861,743. Nonmetal substituted aluminophosphates are described in U.S. Pat. No. 4,973,785.

Methods for forming a non-zeolitic molecular sieves may be found, for example, in U.S. Pat. Nos. 4,440,871; 4,710,485; and 4,973,785. Non-zeolitic molecular sieves are generally synthesized by hydrothermal crystallization from a reaction mixture comprising reactive sources of aluminum, phosphorus, optionally one or more elements, other than aluminum and phosphorous, which are capable of forming oxides in tetrahedral coordination with $AlO_2$ and $PO_2$ units, and one or more organic templating agents. The reaction mixture is placed in a sealed pressure vessel and heated, preferably under autogenous pressure at a temperature of at least about 100° C., and preferably between 100° C. and 250° C., until crystals of the molecular sieve product are obtained, usually for a period of from 2 hours to 2 weeks.

A silicoaluminophosphate molecular sieve is suitable as an intermediate pore size molecular sieve for the present process. The silicoaluminophosphate molecular sieves belong to a class of non-zeolitic molecular sieves characterized by a three-dimensional microporous framework structure of $AlO_2$, and $PO_2$ tetrahedral oxide units with a unit empirical formula on an anhydrous basis of:

$$(Si_xAl_yP_z)O_2$$

wherein "x", "y", and "z" represent the mole fractions, respectively, of silicon, aluminum, and phosphorus, wherein "x" has a value equal to or greater than zero (0), and "y" and "z" each have a value of at least 0.01.

Catalytic particulates containing at least one of the intermediate pore molecular sieves SAPO-11, SAPO-31 and SAPO-41 are particularly useful in the present process. U.S. Pat. No. 4,440,871 describes SAPO's generally and SAPO-11, SAPO-31, and SAPO-41 specifically. The most preferred intermediate pore size silicoaluminophosphate molecular sieve for use in the process of the invention is SAPO-11. When combined with a platinum or palladium hydrogenation component, the SAPO-11 converts the waxy components to produce a lubricating oil having excellent yield, very low pour point, low viscosity and high viscosity index.

SAPO-11 comprises a silicoaluminophosphate material having a three-dimensional microporous crystal framework structure of $PO_2$, $AlO_2$ and $SiO_2$ tetrahedral units whose unit empirical formula on an anhydrous basis is:

$$mR:(Si_xAl_yP_z)O_2$$

wherein "R" represents at least one organic templating agent present in the intracrystalline pore system; "m" represents the moles of "R" present per mole of $(Si_xAl_yP_z)O_2$ and has a value of from zero to about 0.3, "x", "y" and "z" represent respectively, the mole fractions of silicon, aluminum and phosphorous, wherein "x" has a value greater than zero (0), and "y" and "z" each have a value of at least 0.01. The silicoaluminophosphate has a characteristic X-ray powder diffraction pattern which contains at least the d-spacings (as-synthesized and calcined) set forth below in Table I. When SAPO-11 is in the as-synthesized form, "m" preferably has a value of from 0.02 to 0.3.

TABLE I

| 2Θ | Interplanar d-spacings (Å) | Relative Intensity, $I/I_o$ |
|---|---|---|
| 9.4–9.65 | 9.41–9.17 | m |
| 20.3–20.6 | 4.37–4.31 | m |
| 21.0–21.3 | 4.23–4.17 | vs |
| 22.1–22.35 | 4.02–3.99 | m |
| 22.5–22.9 (doublet) | 3.95–3.92 | m-s |

The most particularly preferred intermediate pore SAPO prepared by the present process is SM-3, which has a crystalline structure falling within that of the SAPO-11 molecular sieves. The preparation of SM-3 and its unique characteristics are described in U.S. Pat. Nos. 4,943,424 and 5,158,665. The entire disclosure of each of these patents is incorporated herein by reference for all purposes.

Another intermediate pore size silicoaluminophosphate molecular sieve preferably used in the process of the invention is SAPO-31. SAPO-31 comprises a silicoaluminophosphate having a three-dimensional microporous crystal framework of $PO_2$, $AlO_2$ and $SiO_2$ tetrahedral units whose unit empirical formula on an anhydrous basis is:

$$mR:(Si_xAl_yP_z)O_2$$

wherein R represents at least one organic templating agent present in the intracrystalline pore system; "m" represents the moles of "R" present per mole of $(Si_xAl_yP_z)O_2$ and has a value of from zero to 0.3; "x", "y" and "z" represent, respectively, the mole fractions of silicon, aluminum and phosphorous, wherein "x" has a value greater than zero (0), and "y" and "z" each have a value of at least 0.01. The silicoaluminophosphate has a characteristic X-ray powder diffraction pattern (as-synthesized and calcined) which contains at least the d-spacings set forth below in Table II. When SAPO-31 is in the as-synthesized form, "m" preferably has a value of from 0.02 to 0.3.

TABLE II

| 2Θ | Interplanar d-spacings (Å) | Relative Intensity, $I/I_o$ |
|---|---|---|
| 8.5–8.6 | 10.40–10.28 | m-s |
| 20.2–20.3 | 4.40–4.37 | m |
| 21.9–22.1 | 4.06–4.02 | w-m |
| 22.6–22.7 | 3.93–3.92 | vs |
| 31.7–31.8 | 3.823–2.814 | w-m |

SAPO-41, also suitable for use in the process of the invention, comprises a silicoaluminophosphate having a three-dimensional microporous crystal framework structure of $PO_2$, $AlO_2$ and $SiO_2$ tetrahedral units, and whose unit empirical formula on an anhydrous basis is:

$$mR:(Si_xAl_yP_z)O_2$$

wherein R represents at least one organic templating agent present in the intracrystalline pore system; "m" represents the moles of "R" present per mole of $(Si_xAl_yP_z)O_2$ and has a value of from zero to 0.3; "x", "y" and "z" represent, respectively, the mole fractions of silicon, aluminum and phosphorous, wherein "x" has a value greater than zero (0), and "y" and "z" each have a value of at least 0.01. SAPO-41 has characteristic X-ray powder diffraction pattern (as-synthesized and calcined) which contains at least the d-spacings set forth below in Table III. When SAPO-41 is in the as-synthesized form, "m" preferably has a value of from 0.02 to 0.03.

TABLE III

| 2Θ | Interplanar d-spacings (Å) | Relative Intensity, $I/I_o$ |
|---|---|---|
| 13.6–13.8 | 6.51–6.42 | w-m |
| 20.5–20.6 | 4.33–4.31 | w-m |
| 21.1–21.3 | 4.21–4.17 | vs |
| 22.1–22.3 | 4.02–3.99 | m-s |
| 22.8–23.0 | 3.90–3.86 | m |
| 23.1–23.4 | 3.82–3.80 | w-m |
| 25.5–25.9 | 3.493–3.44 | w-m |

The group of intermediate pore size zeolites useful in the present process include ZSM-22, ZSM-23, ZSM-35, ZSM-48 and SSZ-32. These catalysts are generally considered to be intermediate pore size catalysts based on the measure of their internal structure as represented by their Constraint Index. Zeolites which provide highly restricted access to and egress from their internal structure have a high value for the Constraint Index, while zeolites which provide relatively free access to the internal zeolite structure have a low value for their Constraint Index. The method for determining Constraint Index is described fully in U.S. Pat. No. 4,016,218 which is incorporated herein by reference.

One of the zeolites of the present invention, ZSM-22, is a highly siliceous material which includes crystalline three-dimensional continuous framework silicon containing structures or crystals which result when all the oxygen atoms in the tetrahedra are mutually shared between tetrahedral atoms of silicon or aluminum, and which can exist with a network of mostly $SiO_2$, i.e., exclusive of any intracrystalline cations. The description of ZSM-22 is set forth in full in U.S. Pat. No. 4,556,477, U.S. Pat. No. 4,481,177 and European Patent Application No. 102,716 the contents of which are incorporated herein by reference.

As indicated in U.S. Pat. No. 4,566,477, the crystalline material ZSM-22 has been designated with a characteristic X-ray diffraction pattern as set forth in Table IV.

TABLE IV

Most Significant Lines of ZSM-22

| Interplanar d-spacings (Å) | Relative Intensity ($I/I_o$) |
|---|---|
| 10.9 ± 0.2 | m-vs |
| 8.7 ± 0.16 | w |
| 6.94 ± 0.10 | w-m |
| 5.40 ± 0.08 | w |
| 4.58 ± 0.07 | w |
| 4.36 ± 0.07 | vs |
| 3.68 ± 0.05 | vs |
| 3.62 ± 0.05 | s-vs |
| 3.47 ± 0.04 | m-s |
| 3.30 ± 0.04 | w |
| 2.74 ± 0.02 | w |
| 2.52 ± 0.02 | w |

It should be understood that the X-ray diffraction pattern of Table VII is characteristic of all the species of ZSM-22 zeolite compositions. Ion exchange of the alkali metal cations with other ions results in a zeolite which reveals substantially the same X-ray diffraction pattern with some minor shifts in interplanar spacing and variation in relative intensity.

Furthermore, the original cations of the as-synthesized ZSM-22 can be replaced at least in part by other ions using conventional ion exchange techniques. It may be necessary to pre-calcine the ZSM-22 zeolite crystals prior to ion exchange. In accordance with the present invention, the replacement ions are those taken from Group VIII of the Periodic Table, especially platinum, palladium, iridium, osmium, rhodium and ruthenium.

ZSM-22 freely sorbs normal hexane and has a pore dimension greater than about 4 Å. In addition, the structure of the zeolite provides constrained access to larger molecules. The Constraint Index as determined by the procedure set forth in U.S. Pat. No. 4,016,246 for ZSM-22 has been determined to be from about 2.5 to about 3.0.

Another zeolite which can be used with the present invention is the synthetic crystalline aluminosilicate referred to as ZSM-23, disclosed in U.S. Pat. No. 4,076,842, the contents of which are incorporated herein by reference. The ZSM-23 composition has a characteristic X-ray diffraction pattern as set forth herein in Table V.

TABLE V

| Interplanar d-spacings (Å) | Relative Intensity, $I/I_o$ |
|---|---|
| 11.2 ± 0.23 | m |
| 10.1 ± 0.20 | w |
| 7.87 ± 0.15 | w |
| 5.59 ± 0.10 | w |
| 5.44 ± 0.10 | w |
| 4.90 ± 0.10 | w |
| 4.53 ± 0.10 | s |
| 3.90 ± 0.08 | vs |
| 3.72 ± 0.08 | vs |
| 3.62 ± 0.07 | vs |
| 3.54 ± 0.07 | m |
| 3.44 ± 0.07 | s |
| 3.36 ± 0.07 | w |
| 3.16 ± 0.07 | w |
| 3.05 ± 0.06 | w |
| 2.99 ± 0.06 | w |
| 2.85 ± 0.06 | w |
| 2.54 ± 0.05 | m |
| 2.47 ± 0.05 | w |
| 2.40 ± 0.05 | w |
| 2.34 ± 0.05 | w |

The ZSM-23 composition can also be defined in terms of mole ratios of oxides in the anhydrous state as follows:

$$(0.58–3.4)M_{2/n}O:Al_2O_3:(40–250)SiO_2$$

wherein M is at least 1 cation and n is the valence thereof. As in the ZSM-22, the original cations of as-synthesized ZSM-23 can be replaced in accordance with techniques well-known in the art, at least in part by ionic exchange with other cations. In the present invention these cations include the Group VIII metals as set forth hereinbefore.

Another intermediate pore size zeolite which has been found to be successful in the present invention is ZSM-35, which is disclosed in U.S. Pat. No. 4,016,245, the contents of which are incorporated herein by reference. The synthetic crystalline aluminosilicate known as ZSM-35, has a characteristic X-ray diffraction pattern which is set forth in U.S. Pat. No. 4,016,245. ZSM-35 has a composition which can be defined in terms of mole ratio of oxides in the anhydrous state as follows:

$$(0.3–2.5)R_2O:(0–0.8)M_2O:Al_2O_3:>8SiO_2$$

wherein R is organic nitrogen-containing cation derived from ethylenediamine or pyrrolidine and M is an alkali metal cation. The original cations of the as-synthesized ZSM-35 can be removed using techniques well known in the art which includes ion exchange with other cations. In the present invention, the cation exchange is used to replace the as-synthesized cations with the Group VIII metals set forth herein. It has been observed that the X-ray diffraction pattern of ZSM-35 is similar to that of natural ferrierite with a notable exception being that natural ferrierite patterns exhibit a significant line at 1.33 Å.

Another intermediate pore size zeolite which has been found to be successful in the present invention is SSZ-32, which is disclosed in U.S. Pat. No. 5,053,373, the content of which are incorporated herein by reference. SSZ-32 has a characteristic X-ray diffraction pattern which is set forth in U.S. Pat. No. 5,053,373. The composition of SSZ-32, as synthesized and in the anhydrous state, in terms of mole ratios of oxides, is as follows:

$$(0.05–2.0)R_2O:(0.1–2.0)M_2O:Al_2O_3:(20\text{-less than } 40)SiO_2$$

where M is an alkali metal cation and R is an organic nitrogen-containing cation, such as an N-lower alkyl-N-N'-isopropyl-imidazolium cation. SSZ-32 has a mole ratio of silicon oxide to aluminum oxide in the range of 20 to less than 40, and has essentially the same X-ray diffraction pattern of ZSM-23. Hydroconversion processes using SSZ-32 are disclosed, for example, in U.S. Pat. Nos. 5,300,210 and in 5,397,454.

ZSM-48 is a crystalline aluminosilicate zeolite which is suitable as a dewaxing catalyst for the present invention. Zeolite ZSM-48 is disclosed in U.S. Pat. No. 4,585,747, the entire disclosure of which is incorporated herein by reference for all purposes, and has a characteristic X-ray diffraction pattern as set forth in Table VI.

TABLE VI

| Interplanar d-spacings (Å) | Relative Intensity, $I/I_o$ |
|---|---|
| 11.8 ± 0.2 | s |
| 10.2 ± 0.2 | w-m |
| 7.2 ± 0.15 | w |
| 4.2 ± 0.08 | vs |
| 3.9 ± 0.08 | vs |
| 3.6 ± 0.06 | w |
| 3.1 ± 0.05 | w |
| 2.85 ± 0.05 | w |

Zeolite ZSM-48 can also be identified, in terms of mole ratios of oxides and in the anhydrous state, as follows:

$$(0.1 \text{ to } 4)R_2O:(0.01 \text{ to } 2)M_{2/n}O:(0 \text{ to } 0.5)Al_2O_3:(100)SiO_2$$

wherein M is at least one cation having a valence n and R is the cation. The cation taught in U.S. Pat. No. 4,585,747 is derived from the monomeric, diquaternary compound bis (N-methylpyridyl)ethylinium.

Other molecular sieves which can be used with the present invention include, for example, Theta-1, as described in U.S. Pat. Nos. 4,533,649 and 4,836,910, both of which are incorporated in their entireties by reference, Nu-10, as described in European Patent Application 065,400 which is incorporated in its entirety by reference and SSZ-20 as described in U.S. Pat. No. 4,483,835 which is incorporated in its entirety by reference. X-ray crystallography of SAPO-11, SAPO-31, SAPO-41, ZSM-22, ZSM-23 and ZSM-35 shows these molecular sieves to have the following major and minor axes: SAPO-11, major 6.3 Å, minor 3.9 Å; (Bennett, J. M., et al, Zeolites, 1, 160(87)), SAPO-31 and SAPO-41, believed to be slightly larger than SAPO-11, ZSM-22, major 5.5 Å, minor 4.5 Å (Kokotailo, G. T., et al, Zeolites, 5, 349(85)); ZSM-23, major 5.6 Å, minor 4.5 Å; ZSM-35, major 5.4 Å, minor 4.2 Å. ZSM-48 is a molecular sieve having a 10-ring structure with 1-D pores having a 5.23 Å major axis and a 5.11 Å minor axis. (Meier, W. M. and Olsen, D. H., Atlas of Zeolite Structure Types, Butterworths, 1987).

It is preferred that relatively small crystal size catalyst be utilized in practicing the invention. Suitably, the average crystal size is no greater than about 10 microns (i.e. micrometers), preferably no more than about 5 microns, more preferably no more than about 1 micron and still more preferably no more than about 0.5 micron.

The physical form of the catalyst depends on the type of catalytic reactor being employed and may be in the form of a granule or powder, and is desirably compacted into a more readily usable form (e.g., larger agglomerates), usually with a silica or alumina binder for fluidized bed reaction, or pills, prills, spheres, extrudates, or other shapes of controlled size to accord adequate catalyst-reactant contact. The preferred catalyst is in the form of extrudates with a cross-sectional diameter between about ¼ inch and about 1/32 inch. In the catalyst, the molecular sieve can be composited with other material resistant to the temperatures and other conditions employed in organic conversion processes. Such matrix materials include active and inactive materials and synthetic or naturally occurring zeolites as well as inorganic materials such as clays, silica and metal oxides. Additional porous matrix materials include silica, alumina, titania, magnesia and mixtures thereof. The matrix can be in the form of a cogel. Alumina and silica-alumina matrix materials are preferred.

The intermediate pore size molecular sieve is used in admixture with at least one Group VIII metal. Preferably, the Group VIII metal is selected from the group consisting of at least one of platinum and palladium and optionally, other catalytically active metals such as molybdenum, nickel, vanadium, cobalt, tungsten, zinc and mixtures thereof. Most preferably, the Group VIII metal is selected from the group consisting of at least one of platinum and palladium. The amount of metal ranges from about 0.01% to about 10% by weight of the molecular sieve, preferably from about 0.1% to about 5% by weight and more preferably from about 0.2% to about 1% by weight of the molecular sieve. The techniques of introducing catalytically active metals into a molecular sieve are disclosed in the literature, and preexisting metal incorporation techniques and treatment of the molecular sieve to form an active catalyst such as ion exchange, impregnation or occlusion during sieve preparation are suitable for use in the present process. Such techniques are disclosed in U.S. Pat. Nos. 3,236,761; 3,226,339; 3,236,762; 3,620,960; 3,373,109; 4,202,996; 4,440,781 and 4,710,485; and in U.S. application Ser. No. 08/728818; the entire disclosures of which are incorporated herein by reference for all purposes.

The term "metal" or "active metal" as used herein means one or more metals in the elemental state or in some form such as sulfide, oxide and mixtures thereof. Regardless of the state in which the metallic component actually exists, the concentrations are computed as if they existed in the elemental state.

The catalyst may also contain metals which reduce the number of strong acid sites on the catalyst and thereby lower the selectivity for cracking versus isomerization. Especially preferred are the Group IIA metals such as magnesium and calcium. The Group VIII metal utilized in the process of this invention can mean one or more of the metals in its elemental state or in some form such as the sulfide or oxide and mixtures thereof. As is customary in the art of catalysis, when referring to the active metal or metals, it is intended to encompass the existence of such metal in the elementary state or in some form such as the oxide or sulfide as mentioned above, and regardless of the state in which the metallic component actually exists, the concentrations are computed as if they existed in the elemental state.

The catalytic isomerization step of the invention may be conducted by contacting the feed with a fixed stationary bed of catalyst, with a fixed fluidized bed, or with a transport bed. A simple and therefore preferred configuration is a trickle-bed operation in which the feed is allowed to trickle through a stationary fixed bed, preferably in the presence of hydrogen.

The catalytic isomerization conditions employed depend on the feed used and the desired pour point. Generally, the temperature is from about 200° C. to about 475° C., preferably from about 250° C. and to about 450° C. The pressure is typically from about 15 psig (103 kPa) to about 2500 psig (27.2 MPa), preferably from about 50 psig (345 kPa) to about 2000 psig (13.8 MPa), more preferably from about 100 psig to about 1500 psig (10.3 MPa). The liquid hourly space velocity (LHSV) is preferably from about 0.1 $hr^{-1}$ to about 20 $hr^{-1}$, more preferably from about 0.1 $hr^{-1}$ to about 5 $hr^{-1}$, and most preferably from about 0.1 $hr^{-1}$ to about 1.0 $hr^{-1}$. Low pressure and low liquid hourly space velocity provide enhanced isomerization selectivity which results in more isomerization and less cracking of the feed thus producing an increased yield.

Hydrogen is preferably present in the reaction zone during the catalytic isomerization process. The hydrogen to feed ratio is typically from about 500 to about 30,000 SCF/bbl (standard cubic feet per barrel) (76–4540 std liters $H_2$/kg oil), preferably from about 1,000 to about 10,000 SCF/bbl (151–1510 std liters $H_2$/kg oil). Generally, hydrogen will be separated from the product and recycled to the reaction zone. Strong acidity may also be reduced by introducing nitrogen compounds, e.g., $NH_3$ or organic nitrogen compounds, into the feed; however, the total nitrogen content should be less than 50 ppm, preferably less than 10 ppm.

In the dewaxing process using the catalyst of the present invention, the pour point of the isomerized product is lower than the pour point of the waxy feed to the dewaxing process. For oils of commercial interest, the pour point of the oil is generally below about 10° C., and often below 0° C. While a low pour point is desired in the product from the isomerization step, excessive isomerization has a detrimental effect on product viscosity index, as described hereinbefore. The wax content of the isomerized oil is between about 1% and about 40%, preferably between about 3% and about 20%, of the wax content of the waxy feed. The isomerization step, then preferentially removes between about 60% and about 99% by weight of the wax contained in the waxy feedstock. Thus, the pour point of the isomerized product, while being substantially lower than the pour point of the feed to the isomerization process, will be at least about 60° C., and more usually at least about 12° C. above the target pour point set for the finished lubricating oil base stock. The viscosity index of the isomerized product will be generally above about 140 and preferably above about 150. With some products, a viscosity index of 160 or above is possible.

The wax content of the oil set forth herein is determined from a conventional solvent dewaxing method. An example method is as follows:

300 g of oil is diluted 50/50 with a 4:1 mixture of methyl ethyl ketone and toluene which is cooled to −20° C. in a refrigerator. The mixture is filtered through a Coors funnel at −15° C. using Whatman No. 3 filter paper. The wax is removed from the filter and placed in a tared 2 liter flask. The solvent is removed on a hot plate and the wax weighed.

The present integrated two-step process comprises a catalytic isomerization step and a solvent dewaxing step. Following the isomerization of the waxy feed, the pour point of the isomerized oil will generally be at least about 6° C. and preferably at least about 12° C. above a target pour point of the finished oil. Continued isomerization results in unselective isomerization and the formation of increased numbers of triply branched paraffins, resulting in a reduced viscosity index. Thus, the isomerized oil is solvent dewaxed to a desired target pour point, which is determined by the particular grade of oil which is being produced. The target pour point will generally be less than or equal to about −10° C. For high quality oils, a pour point less than or equal to about −20° C. or even less than or equal to about −30° C. may be preferred. Depending on the dewaxing conditions and the feeds used for the dewaxing process, a viscosity index above 140 can be achieved. Lubricating oil stocks will generally boil above 230° C. (450° F.), more usually above 315° C. (600° F.).

Conventional solvent dewaxing processes which are commonly used in the preparation of a lubricating oil base stock are suitable for the present integrated process. Such processes include crystallization of the wax from a chilled mixture of waxy oil and a solvent such as a blended methyl ethyl ketone/toluene solvent. The slack wax and/or the foots oil recovered as the residual oil remaining in the slack wax may be recovered or recycled to the isomerization reaction zone. The isomerized oil which is the feed to the solvent dewaxing step of the present process will generally have a pour point of less than about 40° C., and a viscosity index of greater than about 125 and preferably greater than about 140, and more preferably greater than about 150.

Feed to the isomerization process may require pretreatment before it can be satisfactorily processed in the isomerization step. The pretreatment steps remove heteroatoms such as nitrogen and sulfur which might poison the isomerization catalyst, or low viscosity index components such as aromatics and polycyclic naphthenes. A typical hydrocracking process is described, for example, in U.S. Pat. No. 5,158,665, the entire disclosure of which is already incorporated by reference.

It may further be desired to hydrofinish the dewaxed oil in a mild hydrogenation process to produce more stable lubrication oils. The hydrofinishing can be conventionally carried out in the presence of a metallic hydrogenation catalyst, for example, platinum on alumina. The hydrofinishing can be carried out at a temperature of from about 190° C. to about 340° C. and a pressure of from about 400 psig to about 3000 psig (2.76–20.7 MPa). A description of a typical hydrofinishing process and catalyst which is useful in the present process is taught in U.S. Pat. No. 5,158,665. Hydrofinishing in this manner is also described in U.S. Pat. No. 3,852,207, both of which are incorporated herein by reference for all purposes.

The present process is suitable for preparing very high viscosity index lubricating oil base stocks having a wide range of viscosities, including base stocks having a viscosity, measured at 100° C., of 10 cSt or higher. These base oils have a viscosity index of at least about 140 (preferably at least about 150 and more preferably at least about 160), and a pour point of less than or equal to about −10° C. (preferably less than or equal to about −20° C., and more preferably less than or equal to about −30° C.). A particularly important base oil prepared in the present process has a viscosity, measured at 100° C., of about 3 cSt or less, preferably less than about 3 cSt, and a viscosity index of at least about 140, preferably at least about 150, and more preferably at least about 160. This relatively light oil prepared in the present process has a viscosity index higher than that produced even in synthetic oils having a viscosity, measured at 100° C., of about 3 cSt or less.

EXAMPLES

Comparative Example A

Tetracosane (n-$C_{24}$, purchased from Aldrich), which had a pour point of +50° C. and a viscosity at 100° C. of about 2.5 cSt, was isomerized over SM-3 impregnated with 0.5 wt % Pt. The catalyst was pelleted, then crushed to 24–42 mesh for testing: The catalyst was sulfided in situ prior to testing by injecting $H_2S$ through a septum into the hydrogen line ahead of the reactor. Isomerization was carried out in a continuous feed high pressure pilot plant with once-through hydrogen gas. Run conditions were 1000 psig total pressure (6.89 MPa), 0.6 $hr^{-1}$ LHSV, and 6.7 MSCF/bbl $H_2$ (1010 std liters $H_2$/kg oil) At a pour point of −25° C., the viscosity index of the 316° C.+distillation bottoms was 132 (Table VII).

Example 1

Tetracosane was isomerized over the same Pt/SM-3 catalyst as in Comparative Example A, but to a pour point of +20° C. The 316° C.+distillation bottoms were then solvent dewaxed (SDW) to a pour point of −29° C. The viscosity index of the oil was 148 (Table VII), much higher (about 18 numbers) than obtained with isomerization only to the same pour point (FIG. I). In addition, the isomerized and solvent dewaxed oil had a much lower average number of branches per molecule.

TABLE VII

ISOMERIZATION OF n-$C_{24}$ OVER Pt/SM-3 AT 1000 PSIG (6.99 MPa), 0.6 $hr^{-1}$ LHSV, AND 6.7 MSCF/BBL $H_2$ (1010 std liters $H_2$/kg oil)

| | Comparative Example A | | Example 1 |
|---|---|---|---|
| Temperature, ° C. | 321 | 332 | 324 |
| n-$C_{24}$ Conversion, wt % | 99.1 | 99.6 | 95.1 |
| Yield, Wt % | | | |
| C4– | 0.5 | 0.9 | 0.2 |
| C5–82° C. | 1.9 | 2.3 | 0.5 |
| 82–177 ° C. | 2.8 | 3.2 | 1.7 |
| 177–316° C. | 8.2 | 12.3 | 4.3 |
| 316° C.+ | 86.6 | 81.3 | 93.3 |
| 316° C. + Distillation Yield, wt % | 87.4 | 82.2 | 92.1 |
| Solvent Dewax | No | No | Yes |
| Oil, wt % | | | 65.6 |
| Wax, wt % | | | 32.4 |
| Pour Point Before SDW, ° C. | | | +20 |
| 316° C. + Lube Yield, wt % | 86.6 | 81.3 | 61.2 |
| 316° C. + Lube Inspections | | | |
| Pour Point, ° C. | −15 | −25 | −29 |
| Cloud Point, ° C. | −1 | −8 | −9 |
| Viscosity, 40 ° C., cSt | 8.636 | 8.372 | 8.313 |
| 100° C., cSt | 2.579 | 2.507 | 2.556 |
| VI | 137 | 132 | 148 |
| Avg. Branches/Molecule | 1.83 | 1.97 | 1.63 |
| Simulated Distillation, LV %, ° C. | | | |
| St/5 | 277/358 | 294/357 | 304/369 |
| 30/50 | 368/379 | 368/379 | 374/382 |
| 50 | 384 | 384 | 385 |
| 70/90 | 388/392 | 388/391 | 388/391 |
| 95/EP | 392/394 | 393/394 | 392/398 |

Comparative Example B

An extrudate catalyst containing 85 wt % SM-3 sieve and 15 wt % Catapal alumina binder was impregnated with 0.4 wt % Pt and crushed to 24–42 mesh (0.35–0.70 mm). It was used to isomerize a 7.8 cSt heavy neutral slack wax (Table VIII) at 0.5 LHSV $hr^{-1}$, 1000 psig (6.99 MPa), and 8 MSCF/bbl $H_2$ (1210 std liters $H_2$/kg oil). Results are given in Table IX, showing a 144 VI at a pour point of −12° C.

Example 2

Comparative Example B was repeated, except in this case, the feed was isomerized over the SM-3 catalyst to a pour point of 0° C., followed by solvent dewaxing to −18° C. The viscosity index (143, Table IX) was about the same as in the comparative example, but the pour point was lower. In addition, the cloud point was considerably lower.

TABLE VIII

| INSPECTIONS OF HEAVY NEUTRAL SLACK WAX | |
|---|---|
| Sulfur, ppm | 7.0 |
| Viscosity, 100° C., cSt | 7.818 |
| Simulated Distillation, LV %, ° C. | |
| St/5 | 198/371 |
| 30/50 | 392/439 |
| 50 | 476 |
| 70/90 | 522/594 |
| 95/EP | 628/696 |

TABLE IX

ISOMERIZATION OF HEAVY NEUTRAL SLACK WAX AT 0.5 $hr^{-1}$ LHSV, 1000 PSIG (6.99 MPa), AND 8 MSCF/BBL $H_2$ (1210 std liters $H_2$/kg oil) OVER Pt/SM-3 CATALYST

| | Comparative Example B | Example 2 |
|---|---|---|
| Temperature, ° C. | 349 | 332 |
| 343° F. + Conversion, wt % | 27.4 | 21.9 |
| Wax Conversion, wt % | 100 | 84.1 |
| Selectivity to Lube, wt % | 67.4 | 72.6 |
| Pour Point before SDW, ° C. | | 0 |
| Solvent Dewax | No | Yes |
| Oil, wt % | | 86.2 |
| Wax, wt % | | 13.8 |
| 650 F. + Lube Yield, wt % | 67.4 | 61.1 |
| Pour Point, ° C. | −12 | −18 |
| Cloud Point, ° C. | +9 | −17 |
| Viscosity, 40° C., cSt | 41.42 | 37.50 |
| 100° C., cSt | 7.367 | 6.836 |
| VI | 144 | 143 |
| Simulated Distillation, LV %, ° C. | | |
| St/5 | 193/357 | 226/358 |
| 30/50 | 378/425 | 377/419 |
| 50 | 464 | 456 |
| 70/90 | 511/585 | 500/579 |
| 95/EP | 617/717 | 629/747 |

Comparative Example C

An SM-3 catalyst similar to that of Comparative Example B was used to isomerize a hydrotreated 4.5 cSt slack wax (Table X) at 0.5 $hr^{-1}$ LHSV, 800 psig total pressure (5.61 MPa), and 3 MSCF/bbl $H_2$ (454 std liters $H_2$/kg oil). Results are given in Table XI, showing a 140 VI at a pour point of −7° C.

Example 3

Comparative Example C was repeated, except in this case, the feed was isomerized at 1100 psig (7.58 MPa) over the SM-3 catalyst to a pour point of −3° C., followed by solvent dewaxing to −14° C. The viscosity index (144, Table XI) was higher than in the comparative example, and the pour point was lower.

TABLE X

| INSPECTIONS OF HYDROTREATED SLACK WAX | |
|---|---|
| Density | 0.84 g/$cm^3$ |
| Sulfur, ppm | 33 |
| Nitrogen, ppm | 0.3 |
| Pour Point, ° C. | +39 |
| Viscosity, 70° C., cSt | 8.120 |

TABLE X-continued

| INSPECTIONS OF HYDROTREATED SLACK WAX | |
|---|---|
| 100° C.,cSt | 4.465 |
| Wax, wt % | 58.2 |
| Dewaxed Oil Properties | |
| Pour Point, ° C. | −8 |
| Cloud Point, ° C. | −8 |
| Viscosity, 40° C., cSt | 21.82 |
| 100° C., cSt | 4.609 |
| VI | 130 |

TABLE XI

ISOMERIZATION OF HYDROTREATED SLACK WAX AT 0.5 $hr^{-1}$ LHSV AND 3 MSCF/BBL $H_2$ (450 std liters $H_2$/kg oil) OVER Pt/SM-3 CATALYST

| | Comparative Example C | Example 3 |
|---|---|---|
| Temperature, ° C. | 327 | 327 |
| Pressure, MPa | 5.61 | 7.68 |
| Conversion <371° C., wt % | 28.9 | 23.7 |
| Yields, Wt % | | |
| C4– | 2.2 | 2.0 |
| C5–82° C. | 3.8 | 3.3 |
| 180–371° C. | 31.7 | 27.8 |
| 371° C.+ | 62.8 | 67.3 |
| 371° C. + Yield, Wt % | 62.6 | 66.8 |
| Pour Point before SDW, ° C. | | −3 |
| Solvent Dewax | No | Yes |
| Oil, wt % | | 96 |
| Wax, wt % | | 4 |
| 371° C. + Lube Yield, wt % | 62.6 | 64 |
| Pour Point, ° C. | −7 | −14 |
| Cloud Point, ° C. | −4 | −11 |
| Viscosity, 40° C., cSt | 22.0 | 21.98 |
| 100° C., cSt | 4.746 | 4.785 |
| VI | 140 | 144 |
| Simulated Distillation, LV %, ° C. | | |
| ST/5 | 287/368 | 294/371 |
| 30/50 | 436/452 | 738/454 |
| 95/99 | 486/501 | 488/502 |

Comparative Example D

An extrudate catalyst containing 65 wt % SSZ-32 zeolite and 35 wt % Catapal alumina binder was impregnated with 0.35 wt % Pt and crushed to 24–42 mesh (0.35–0.70 mm). After pre-sulfiding with $H_2S$, it was used to isomerize tetracosane at 0.6 $hr^{-1}$ LHSV, 1000 psig (6.99 MPa), and 6.7 MSCF/bbl $H_2$ (1010 std liters $H_2$/kg oil). Results are given in Table XII, showing a 152 VI at a pour point of −9° C. and a 143 VI at a pour point of −33° C.

Example 4

Comparative Example D was repeated, except in this case, the feed was isomerized over the SSZ-32 catalyst to a pour point of +4° C., followed by solvent dewaxing to −21° C. The viscosity index (156, Table XII) was higher than in the comparative example by an estimated 8–9 numbers at the same pour point.

TABLE XII

ISOMERIZATION OF n-$C_{24}$ AT 1000 PSIG (6.99 MPa), 0.6 $hr^{-1}$ LHSV, AND 6.7 MSCF/BBL $H_2$ (1010 std liters h2/kg oil) OVER Pt/SSZ-32 CATALYST

| | Comparative Example D | | Example 4 |
|---|---|---|---|
| Temperature, ° C. | 307 | 324 | 310 |
| n-$C_{24}$ Conversion, wt % | 98.9 | 99.8 | 87.9 |
| Yields, Wt % | | | |
| C1–C2 | 0.3 | 0.4 | 0.3 |
| C3–C4 | 4.7 | 5.4 | 1.8 |
| C5–82° C. | 7.4 | 8.4 | 2.7 |
| 82–177° C. | 11.9 | 12.0 | 2.8 |
| 177–316° C. | 12.2 | 14.8 | 8.8 |
| 316° C.+ | 63.5 | 59.0 | 82.7 |
| 316° C. + Distillation Yield, Wt % | 64.4 | 68.5 | 88.9 |
| Solvent Dewax | No | No | Yes |
| Oil, Wt % | | | 86.1 |
| Wax, Wt % | | | 11.5 |
| Pour Point before SDW, ° C. | | | +4 |
| 316° C. + Lube Yield, Wt % | 63.5 | 59.0 | 52.9 |
| 316° C. + Lube Inspections | | | |
| Pour Point, ° C. | −9 | −33 | −21 |
| Cloud Point, ° C. | +2 | −13 | −7 |
| Viscosity, 40° C., cSt | 8.028 | 6.414 | 7.669 |
| 100° C., cSt | 2.506 | 2.121 | 2.445 |
| VI | 152 | 143 | 156 |
| Avg. Branches/Molecule | 1.60 | | |
| Simulated Distillation, LV %, ° C. | | | |
| St/5 | 273/333 | 156/240 | 218/294 |
| 30/50 | 371/383 | 278/373 | 373/385 |
| 50 | 387 | 380 | 389 |
| 70/90 | 390/393 | 383/387 | 391/394 |
| 95/EP | 393/395 | 388/391 | 394/394 |

TABLE XIII

ISOMERIZATION OF n-$C_{24}$ AT 1000 PSIG (6.99 MPa), 0.6 $hr^{-1}$ LHSV, AND 6.7 MSCF/BBL $H_2$ (1010 std liters $H_2$/kg oil)

| | Comparative Example E | Comparative Example F | Example 1 |
|---|---|---|---|
| Catalyst | Pt/B-Beta | Pt/SiO2—Al2O3 | Pt/SM-3 |
| Temperature, ° C. | 319 | 329 | 324 |
| n-$C_{24}$ Conversion, Wt % | 95.2 | 92.4 | 95.1 |
| Yields, Wt % | | | |
| C4– | 2.8 | 0.3 | 0.2 |
| C5–82° C. | 5.4 | 1.3 | 0.5 |
| 82–177° C. | 7.3 | 2.0 | 1.7 |
| 177–316° C. | 16.6 | 6.7 | 4.3 |
| 316° C.+ | 67.9 | 89.7 | 93.3 |
| 316° C. + Dist. Yield, Wt % | 69.0 | 90.3 | 92.1 |
| Solvent Dewax | Yes | Yes | Yes |
| Oil, wt % | 86.4 | 86.1 | 65.6 |
| Wax, wt % | 13.1 | 11.5 | 32.4 |
| Pour Point before SDW, ° C. | +16 | +22 | +20 |
| 316° C. + Lube Yield, Wt % | 58.7 | 77.2 | 61.2 |
| 316° C. + Lube Inspections | | | |
| Pour Point, ° C. | −18 | −15 | −29 |
| Cloud Point, ° C. | −13 | −11 | −9 |
| Viscosity, 40° C., cSt | 8.354 | 8.364 | 8.313 |
| 100° C., cSt | 2.517 | 2.481 | 2.556 |
| VI | 136 | 126 | 148 |
| Avg. Branches/Molecule | 1.86 | 2.02 | 1.63 |
| Simulated Dist., LV %, ° C. | | | |
| St/5 | 298/343 | 316/360 | 304/369 |
| 30/50 | 364/375 | 365/375 | 374/382 |
| 50 | 381 | 375 | 385 |
| 70/90 | 385/389 | 385/390 | 388/391 |
| 95/EP | 390/392 | 391/392 | 392/398 |

Comparative Example E

A boron-Beta zeolite was prepared according to Example 18 of U.S. Pat. No. 5,558,851. This zeolite, which had a $SiO_2/B_2O_3$ mole ratio of about 60, was NH4-exchanged and then impregnated with 0.5 wt % Pt. The catalyst was pelleted and crushed to 24–42 mesh (0.35–0.70 mm). After pre-sulfiding with $H_2S$, the catalyst was used to isomerize tetracosane at 1000 psig (6.99 MPa), 0.6 $hr^{-1}$ LHSV, and 6.7 MSCF/bbl $H_2$ (1010 std liters $H_2$/kg oil) to a pour point of +16° C., then solvent dewaxed to a pour point of −18° C. The viscosity index after solvent dewaxing was considerably lower than for the catalysts of this invention (Table XIII).

Figure 2:
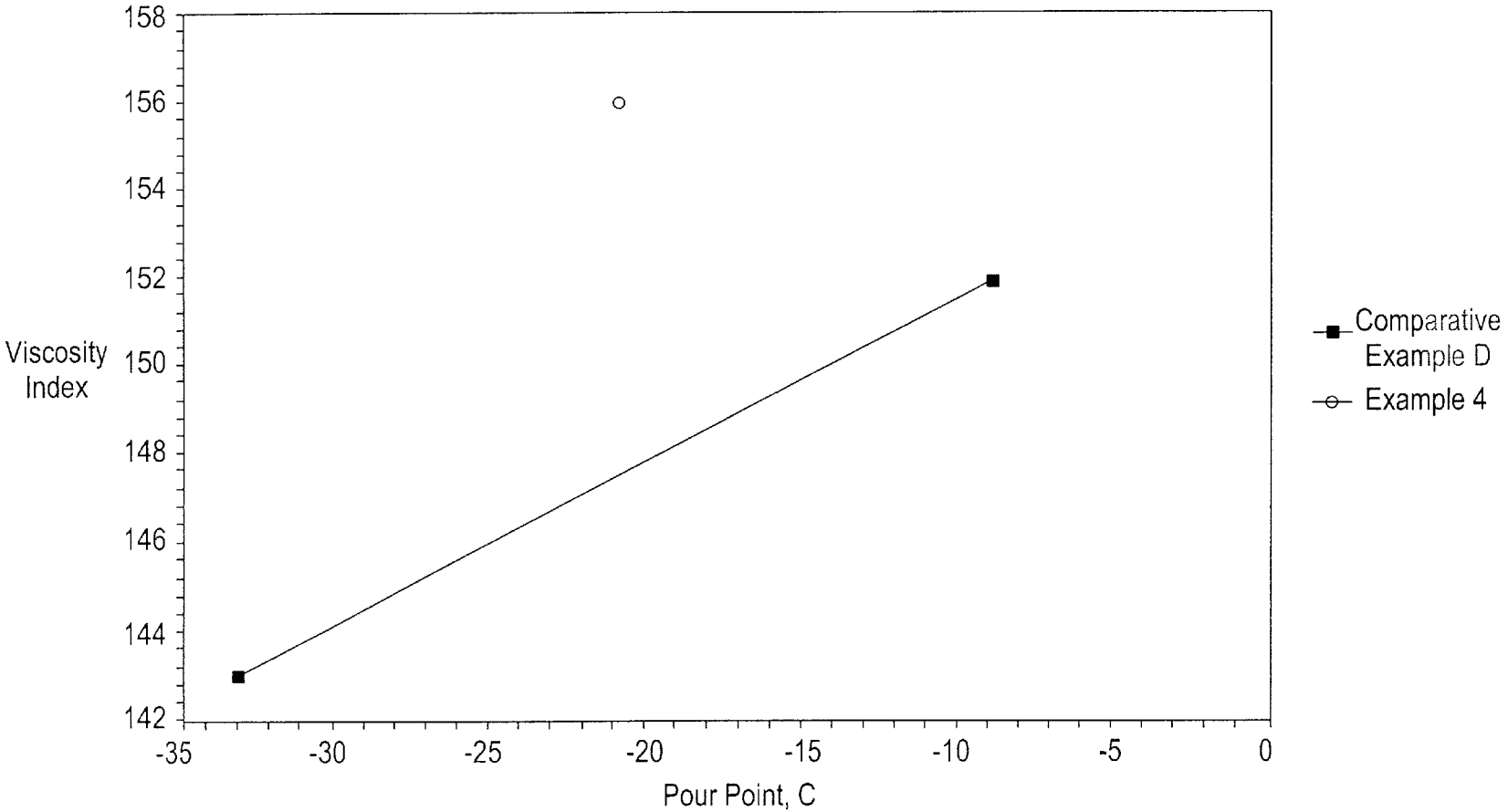
FIG. 2 shows the benefit of isomerizing a waxy feed with SSZ-32 and solvent dewaxing the isomerized oil compared to isomerizing the waxy feed alone.

Comparative Example F 0.5 wt % Pt was impregnated on an amorphous cogelled SiO2-alumina base extrudate (31 wt % SiO2, 69 wt % Al2O3). The catalyst was crushed to 24–42 mesh (0.35–0.70 mm) for testing. After pre-sulfiding with $H_2S$, it was used to isomerize tetracosane at 1000 psig (6.99 MPa), 0.6 LHSV, and 6.7 MSCF/bbl $H_2$ (1010 std liters $H_2$/kg oil) to a pour point of +22° C., then solvent dewaxed to a pour point of −15° C. The viscosity index after solvent dewaxing was considerably lower than for the catalysts of this invention (Table XIII and FIG. 2). In addition, the isomerized and solvent dewaxed oil had a much higher average number of branches per molecule.

What is claimed is:

1. A process for preparing an oil suitable for use as a lubricating oil base stock comprising:

(a) contacting a waxy feed over a dewaxing catalyst comprising a molecular sieve having 1-D pores with a pore diameter of between about 5.0 Å and about 7.0 Å, and at least one Group VIII metal, at a pressure of from about 15 psig (103 kPa) to about 2500 psig (13.8 MPa) to partially dewax the feed by converting between 80% to 97% by weight of the wax contained in the waxy feed thus producing an isomerized oil having a pour point of at least 6° C. above a target pour point; and thereafter (b) solvent dewaxing the isomerized oil of step (a) to produce a lubricating oil base stock, whereby the lubricating base oil so produced by steps (a) and (b) has a viscosity index greater than 140 and a target pour point of less than or equal to −20° C. with a branching index of less than 1.75.

2. The process according to claim 1 for preparing a lubricating oil base stock having a target pour point of less than about −20° C.

3. The process according to claim 1 for preparing a lubricating oil base stock having a viscosity index of greater than 150.

4. The process according to claim 1 wherein the waxy feed contains more than about 50% wax.

5. The process according to claim 4 wherein the waxy feed contains more than about 80% wax.

6. The process according to claim 4 wherein the waxy feed is selected from the group consisting of synthetic oils and waxes produced by Fischer-Tropsch synthesis, high pour point polyalphaolefins, foots oils, normal alpha olefin waxes, slack waxes, deoiled waxes and microcrystalline waxes.

7. The process according to claim 1 wherein the waxy feed contains more than about 70% paraffinic carbon.

8. The process according to claim 1 wherein the waxy feed is selected from the group consisting of synthetic oils and waxes produced by Fischer-Tropsch synthesis, high pour point polyalphaolefins, foots oils, normal alpha olefin waxes, slack waxes, deoiled waxes and microcrystalline waxes.

9. The process according to claim 1 wherein the isomerized oil has a pour point of greater than about 0° C.

10. The process according to claim 1 wherein the molecular sieve has 1-D pores having a minor axis between about 3.9 Å and about 4.8 Å and a major axes between about 5.4 Å and about 7.0 Å.

11. The process according to claim 1 wherein the molecular sieve is selected from the group consisting of SAPO-11, SAPO-31 and SAPO-41.

12. The process according to claim 1 wherein the molecular sieve is SM-3.

13. The process according to claim 1 wherein the molecular sieve is selected from the group consisting of ZSM-22, ZSM-23, ZSM-35 and SSZ-32.

14. The process according to claim 13 wherein the molecular sieve is SSZ-32.

15. The process according to claim 1 wherein the molecular sieve is ZSM-48.

16. The process according to claim 1 wherein the at least one Group VIII metal is selected from the group consisting of platinum, palladium or mixtures thereof.

17. The process according to claim 16 wherein, the catalyst contains from about 0.2% to about 1% by weight of the Group VIII metal.

18. The process of claim 1 wherein the catalyst comprising the molecular sieve has sufficient isomerization selectivity such that, when contacting a n-$C_{24}$ feed at a total pressure of 1000 psig (6.99 MPa), hydrogen flow equivalent to 6.7 MSCF/bbl (1010 std liters $H_2$/kg oil), and a feed rate equivalent to 0.6 $hr^{-1}$ LHSV with the catalyst, to produce a 316° C.+ dewaxed product having a pour point of about +20° C. and solvent dewaxing the dewaxed product to a pour point of −15° C. or below, an isomerized product having a branching index of less than about 1.75 is formed.

19. The process according to claim 1 where the BI is 1.63 or less.

20. A process for preparing an oil suitable for use as a lubricating oil base stock comprising:

(a) contacting a waxy feed over a dewaxing catalyst comprising a molecular sieve having 1-D pores with a pore diameter of between about 5.0 Å and about 7.0 Å, and at least one Group VIII metal, at a pressure of from about 15 psig (103 kPa) to about 2500 psig (13.8 MPa) to partially dewax the feed to remove between about 80% and about 97% by weight of the wax contained in the waxy feed, to produce an isomerized oil having a pour point greater than 0° C.; and, thereafter (b) solvent dewaxing the isomerized oil of step (a) to produce a lubricating oil base stock with a target pour point less than or equal to −10° C. and a viscosity index of greater than about 140 and a viscosity, measured at 100° C., of 3 cSt or less and also having a branching index of less than 1.75.

21. The process according to claim 20 wherein the viscosity of the lubricating oil base stock, measured at 100° C., is less than about 3 cSt and the pour point is less than or equal to −20° C.

22. The process according to claim 20 wherein the viscosity index of the lubricating oil base stock is greater than 150 and the pour point is less than −20° C.

23. The process according to claim 20 wherein the molecular sieve is SSZ-32.

24. The process according to claim 20 wherein the molecular sieve is SM-3.

25. The process according to claim 20 where the BI is 1.63 or less.

26. A process for preparing an oil suitable for use as a lubricating oil base stock comprising:

(a) contacting a Fischer-Tropsch waxy feed over a dewaxing catalyst comprising a molecular sieve having 1-D pores with a pore diameter of between about 5.0 Å and about 7.0 Å, and at least one Group VIII metal, at a pressure of from about 15 psig (103 kPa) to about 2500 psig (13.8 MPa) to partially dewax the feed by converting between 80% to 97% by weight of the wax contained in the waxy feed thus producing an isomerized oil having a pour point of at least 6° C. above a target pour point; and thereafter (b) solvent dewaxing the isomerized oil of step (a) to produce a lubricating oil base stock, whereby the lubricating base oil so produced by steps (a) and (b) has a viscosity index greater than 140 and a target pour point of less than or equal to −20° C. with a branching index of less than 1.75.

27. The process according to claim 26 wherein the isomerized oil has a pour point of greater than about 0° C.

28. The process according to claim 26 wherein waxy feed has more than 70% paraffinic carbon and the lubricating oil base stock has a viscosity index greater than 150.

29. The process according to claim 26 where the BI is 1.63 or less.

30. The process according to claim 26 wherein the molecular sieve is selected from the group consisting of SAPO-11, SAPO-31, SAPO-41, SM-3, ZSM-22, ZSM-23, ZSM-35, SSZ-32, and ZSM-48.

31. A process for preparing an oil suitable for use as a lubricating oil base stock comprising:

(a) contacting a Fischer-Tropsch waxy feed over a dewaxing catalyst comprising a molecular sieve having 1-D pores with a pore diameter of between about 5.0 Å and about 7.0 Å, and at least one Group VIII metal, at a pressure of from about 15 psig (103 kPa) to about 2500 psig (13.8 MPa) to partially dewax the feed by converting between 80% to 97% by weight of the wax contained in the waxy feed, to produce an isomerized oil having a pour point greater than 0° C.; and, thereafter (b) solvent dewaxing the isomerized oil of step (a) to produce a lubricating oil base stock with a target pour point less than or equal to −10° and a viscosity index of greater than about 140 and a viscosity, measured at 100° C., of 3 cSt or less and also having a branching index of less than 1.75.

32. The process according to claim 31 wherein the viscosity of the lubricating oil base stock, measured at 100° C., is less than about 3 cSt and the pour point is less than or equal to −20° C.

33. The process according to claim 31 wherein the viscosity index of the lubricating oil base stock is greater than 150 and the pour point is less than −20° C.

34. The process according to claim 31 where the BI is 1.63 or less.

35. The process according to claim 31 wherein the molecular sieve is selected from the group consisting of SAPO-11, SAPO-31, SAPO-41, SM-3, ZSM-22, ZSM-23, ZSM-35, SSZ-32, and ZSM-48.

* * * * *

UNITED STATES PATENT AND TRADEMARK OFFICE

CERTIFICATE OF CORRECTION

PATENT NO. : 6,663,768 B1
APPLICATION NO. : 09/107835
DATED : December 16, 2003
INVENTOR(S) : Miller It is certified that error appears in the above-identified patent and that said Letters Patent is hereby corrected as shown below:

On title page and column 1, lines 1-2
(54) Title, change "Preparing a High Viscosity Index Low Branch Index Dewaxed" to --Preparing a High Viscosity Index, High Branch Index Dewaxed Oil--.

Signed and Sealed this

Fifth Day of June, 2007

JON W. DUDAS
*Director of the United States Patent and Trademark Office*